US010214799B2

(12) United States Patent
Han et al.

(10) Patent No.: US 10,214,799 B2
(45) Date of Patent: Feb. 26, 2019

(54) HEAT TREATMENT METHOD FOR INCREASING THE DEPTH OF HARDENING LAYER IN A STEEL RAIL AND STEEL RAIL OBTAINED WITH THE METHOD

(71) Applicants: PanGang Group Panzhihua Iron & Steel Research Institute Co., Ltd., Panzhihua (CN); Pangang Group panzhihua Steel & Vanadium CO., Ltd., Panzhihua (CN)

(72) Inventors: Zhenyu Han, Panzhihua (CN); Ming Zou, Panzhihua (CN); Jihai Jia, Panzhihua (CN); Hua Guo, Panzhihua (CN); Dadong Li, Panzhihua (CN); Yong Deng, Panzhihua (CN); Chunjian Wang, Panzhihua (CN); Jun Yuan, Panzhihua (CN); Chongmu Chen, Panzhihua (CN)

(73) Assignees: PanGang Group Panzhihua Iron & Steel Research Institute Co., Ltd., Panzhihua (CN); Pangang Group Panzhihua Steel & Vanadium Co., Ltd., Panzhihua (CN)

( * ) Notice: Subject to any disclaimer, the term of this patent is extended or adjusted under 35 U.S.C. 154(b) by 476 days.

(21) Appl. No.: 14/798,980

(22) Filed: Jul. 14, 2015

(65) Prior Publication Data

US 2016/0010188 A1 Jan. 14, 2016

(30) Foreign Application Priority Data

Jul. 14, 2014 (CN) ..... 2014 1 0334751

(51) Int. Cl.

| | |
|---|---|
| ***C21D 9/04*** | (2006.01) |
| ***C22C 38/24*** | (2006.01) |
| ***C22C 38/04*** | (2006.01) |
| ***C22C 38/02*** | (2006.01) |

(52) U.S. Cl.

CPC ..... *C22C 38/24* (2013.01); *C21D 9/04* (2013.01); *C22C 38/02* (2013.01); *C22C 38/04* (2013.01); *C21D 2211/009* (2013.01); *C21D 2221/10* (2013.01)

(58) Field of Classification Search

CPC ..... C21D 9/04

USPC ..... 148/581, 582, 584

See application file for complete search history.

(56) References Cited

U.S. PATENT DOCUMENTS 5,762,723 A * 6/1998 Ueda ..... C21D 1/84 148/320

2009/0314049 A1* 12/2009 Ueda ..... C21D 8/0205 72/364

* cited by examiner

*Primary Examiner* — Brian D Walck

(74) *Attorney, Agent, or Firm* — Volpe and Koenig, P.C.

(57) ABSTRACT

The present invention relates to a heat treatment method for increasing the depth of hardening layer in a steel rail, and belongs to the field of steel rail production process. The technical problem to be solved in the present invention is to provide a heat treatment method for increasing the depth of hardening layer in a steel rail and a steel rail obtained with the method. The method comprises the following steps: cooling a finished rolling steel rail by natural cooling, till the temperature at the center of rail head surface is 660~730° C.; cooling the steel rail by accelerated cooling at 1.5~3.5° C./s cooling rate, till the temperature at the center of rail head surface is 500~550° C.; increasing the cooling rate by 1.0~2.0° C./s and further cooling down the steel rail, till the temperature at the center of rail head surface is 450° C. or lower; then, stopping the accelerated cooling, and cooling down the steel rail by air cooling to room temperature. With the heat treatment method disclosed in the present invention, a deep-hardening layer thicker than 25 mm can be obtained in the rail head part, the portion within 25 mm depth below the surface layer of rail head has hardness equivalent to the hardness of the surface layer of rail head, and the rail head is in a pearlite structure across its cross section. Thus, the service performance of the steel rail against the wearing incurred by the contact between the train wheels and the steel rails can be improved.

6 Claims, No Drawings

HEAT TREATMENT METHOD FOR INCREASING THE DEPTH OF HARDENING LAYER IN A STEEL RAIL AND STEEL RAIL OBTAINED WITH THE METHOD

CROSS REFERENCE TO RELATED APPLICATIONS

This application claims priority to Chinese Application No. 201410334751.7, filed on Jul. 14, 2014, entitled "Heat Treatment Method for Increasing the Depth of Hardening layer in a Steel Rail", which is specifically and entirely incorporated by reference.

FIELD OF THE INVENTION

The present invention relates to a heat treatment method for increasing the depth of hardening layer in a steel rail and a steel rail obtained with the method, and belongs to the field of steel rail production process.

BACKGROUND OF THE INVENTION

At present, most of the steel rails widely used for railroads in China and foreign countries are made of eutectoid steel, the microscopic structure of which mainly consists of pearlites and contains trace ferrites, characterized in good toughness matching and moderate performance, etc. In the process of operation, under the complex stresses from the wheels and the friction force, the rail profile will change as the surface layer of rail head is worn down, causing degraded smoothness of train operation; especially, at sharp radius curves of heavy-load mixed passenger/freight transportation railroads and heavy-duty railroads, the inner steel rail may be crushed easily, and the outer steel rail may have severe side wearing; consequently, the condition of contact between the train wheels and the steel rails become severe and the dynamic interaction between the train wheels and the steel rails is increased, causing degraded operation quality, shortened service life of the steel rails, and increased maintenance cost of the railroad. The abrasion of the outer steel rail to the limit is one of the main causes for replacement of the steel rails at sharp radius curves.

At present, usually heat-treated steel rails with higher hardness rating are used at small radius curves of heavy-duty or heavy-load railroads, in order to improve the wear resistance of the steel rails by means of increasing hardness; in addition, other measures, such as applying oil to the steel rails and improving the contact condition between the train wheels and the steel rails, are taken at railroad sections where the wearing condition is harsh, in order to decrease the wearing rate. Compared with hot-rolled steel rails, heat-treated steel rails may have strength and hardness higher by 30% than those of hot-rolled steel rails, thanks to the strong refined crystalline strengthening effect produced in an accelerated cooling process, and may have toughness and plasticity equivalent or even superior to those of hot-rolled steel rails, which is to say, heat-treated steel rails have better overall strength and toughness properties. However, since heat-treated steel rails are usually cooled with compressed air, water-vapor mixture, or liquid water as the accelerated cooling medium, the effective cooling rate will be decreased quickly as the depth from the surface layer of rail head increases in the heat treatment process, resulting in significant difference in hardness between the deep zone in the rail head and the surface layer of rail head. For example, the hardness at 15 mm depth below the rail head surface can be lower by 2-3 HRC than that of the surface layer. In the actual service process of a steel rail, as the surface layer of rail head is worn down and the hardness is decreased, the wear resistance is decreased accordingly, and the service life of the steel rail exhibits a quick downtrend, adverse to the service life of the steel rail. Therefore, there is an urgent need for a heat treatment method for increasing the hardness within a 25 mm deep zone below the surface layer of rail head to a value comparable to the hardness of the surface layer, so as to obtain a deep-hardened pearlite steel rail and ensure persistent high service performance of the steel rail.

SUMMARY OF THE INVENTION

The technical problem to be solved in the present invention is to provide a heat treatment method for increasing the depth of hardening layer in a steel rail, with which the depth of hardening layer in the rail head part of the steel rail can be increased.

The heat treatment method for increasing the depth of hardening layer in steel rail provided in the present invention comprises the following steps:

a. natural cooling: cooling a finished rolling steel rail by natural cooling, till the temperature at the center of rail head surface dropping to 660~730° C.;
b. first accelerated cooling stage: cooling the steel rail cooled down in step a by accelerated cooling at 1.5~3.5° C./s cooling rate, till the temperature at the center of rail head surface is 500~550° C.;
c. second accelerated cooling stage: cooling the steel rail cooled down in step b by accelerated cooling at a cooling rate that is 1.0~2.0° C./s higher than the cooling rate in the first accelerated cooling stage, till the temperature at the center of rail head surface is 450° C. or lower;
d. air cooling: stopping the accelerated cooling, and cooling down the steel rail by air cooling to room temperature.

Wherein, both the accelerated cooling in the first stage and the accelerated cooling in the second stage are carried out by applying a cooling medium to the rail head surface and both sides of the steel rail.

Any common cooling medium in the art is applicable to the present invention. Preferably, the cooling medium is at least one of compressed air, water-vapor mixture, and gas-oil mixture.

According to the present invention, preferably the temperature of the finished rolling steel rail is 850~1,000° C. In fact, the finished rolling steel rail is the steel rail after finished rolling.

The heat treatment method for increasing the depth of hardening layer in steel rail provided in the present invention is applicable to steel rails with 0.75%~0.90% carbon content. A steel that contains the components of a pearlite steel rail is smelted in a rotary furnace or electric furnace, treated by LF refining, RH or VD vacuum treatment, and cast into a continuous casting billet with an appropriate cross section; the continuous casting billet is fed into a walking beam furnace, heated up to 1,200~1,300° C., and kept heat preservation for 2 h or longer; then, the billet is rolled into a steel rail with a required cross section. Here, the finished rolling temperature of the steel rail is 850~1,000° C.

In the heat treatment method for increasing the depth of hardening layer in a steel rail in the present invention, the accelerated cooling is carried out in two stages. In the first stage, the initial temperature of accelerated cooling is 660~730° C., the cooling rate is 1.5~3.5° C./s, and the final cooling temperature is 500~550° C., at which the second stage of accelerated cooling begins; in the second stage, the cooling rate is higher by 1.0~2.0° C./s than that in the first stage, and the final cooling temperature is 450° C. or lower; then, the accelerated cooling is stopped.

Wherein, the hot-rolled steel rail must be cooled by natural cooling till the temperature at the center of rail head surface is 660~730° C., before the accelerated cooling begin. The reason is: the steel rail is cooled continuously and slowly from an austenite phase region, and has phase transformation from austenite to pearlite when the temperature reaches to the phase transformation point and a required degree of super-cooling is obtained. If the accelerated cooling is started directly at a high temperature after the steel rail is rolled, the temperature of the surface layer of rail head will drop quickly owing to the direct action of the cooling medium on the surface layer of rail head; in contrast, though the temperature of the core part of rail head drops, the cooling rate there is lower than that in the surface layer of rail head, because the core part of rail head only suffers the heat transfer in the surface layer of rail head and to certain depth; especially, since the surface layer of rail head releases latent heat of phase transformation, the hardness of the core part of rail head can't decrease further; instead, it may increase. Consequently, the degree of super-cooling for phase transformation to pearlite is low, and expected properties (e.g., hardness) can't be obtained. The above problem can be avoided effectively if the accelerated cooling is started when the temperature at the center of rail head surface drops to 660~730° C.; if the initial temperature of accelerated cooling is higher than 730° C., expected properties can't be obtained because the degree of super-cooling for phase transformation in the core part of rail head is too low; if the initial temperature of accelerated cooling is lower than 660° C., unwanted structures such as bainite and martensite may occur owing to a high degree of super-cooling because the temperature of the surface layer of rail head reaches to the phase transformation temperature quickly in the early stage of accelerated cooling, resulting in an unacceptable steel rail product. Therefore, the initial temperature of first accelerated cooling stage is set to 660~730° C.

The cooling rate in the first accelerated cooling stage is 1.5~3.5° C./s. If the cooling rate is lower than 1.5° C./s, it is unable to give full play to the refined crystalline strengthening effect that occurs in the heat treatment process; as a result, neither the properties of the surface layer of the steel rail nor the properties of the core part can be improved effectively. If the cooling rate is higher than 3.5° C./5, there is also a risk of occurrence of unwanted structures in the surface layer of rail head in the phase transformation process. Hence, the cooling rate in the first accelerated cooling stage should be 1.5~3.5° C./s.

The initial temperature in the second accelerated cooling stage is 500~550° C. If the final cooling temperature of the surface layer of rail head is lower than 500° C., the contribution of a further increased cooling rate to the improvement of the hardness of the core part of rail head will be very limited, since the phase transformation has completed essentially in the surface layer of rail head and within a specific range of depth in the steel rail; if the final cooling temperature of the surface layer of rail head is higher than 550° C., an increased cooling rate will bring a threat to the microscopic structure of the steel rail at the boundary between the surface layer of rail head and the core part of rail head in the positive segregation region, since the phase transformation in the surface layer and within a certain depth of the steel rail has not completed yet. Hence, the initial temperature in the second accelerated cooling stage is set to 500~550° C.

The cooling rate in the second accelerated cooling stage is increased by 1.0~2.0° C./s on the basis of the 1.5~3.5° C./s cooling rate in the first accelerated cooling stage, because: the cooling rate in the core part of rail head is lower than that in the surface layer of rail head that is directly subject to the cooling action of the cooling medium; in addition, the core part of rail head must be cooled at a quick cooling rate also, in order to obtain properties comparable to those of the surface layer, in view of the effect of latent heat of phase transformation. If the increased amount of cooling rate is less than 1.0° C./s, expected properties (e.g., high hardness) can't be obtained, though the degree of super-cooling for phase transformation in the core part of rail head is increased to some degree; if the increased amount of cooling rate exceeds 2.0° C./s, a risk of occurrence of unwanted structures will occur also. Therefore, the cooling rate in the second stage is increased by 1.0~2.0° C./s on the basis of the cooling rate in the first stage.

When the temperature at the center of rail head surface drops to 450° C., continuing the accelerated cooling is meaningless since the phase transformation has completed across the cross section of the rail head. At this point, the follow-up procedures can be started, and ultimately a finished steel rail product can be obtained.

The present invention further provides a steel rail obtained with the heat treatment method disclosed in the present invention.

With the heat treatment method for increasing the depth of hardening layer in a steel rail in the present invention, a deep-hardening layer thicker than 25 mm can be obtained in the rail head part, the portion within 25 mm depth below the surface layer of rail head has hardness equivalent to the hardness of the surface layer of rail head, and the rail head is in a pearlite structure across its cross section (or contains trace ferrite). Thus, the service performance of the steel rail against the wearing incurred by the contact between train wheels and the steel rail can be improved.

DETAILED DESCRIPTION

The heat treatment method for increasing the depth of hardening layer in steel rail provided in the present invention comprises the following steps:

a. natural cooling: cooling a finished rolling steel rail by natural cooling, till the temperature at the center of rail head surface dropping to 660730° C.;
b. first accelerated cooling stage: cooling the steel rail cooled down in step a by accelerated cooling at 1.5~3.5° C./s cooling rate, till the temperature at the center of rail head surface is 500~550° C.;
c. second accelerated cooling stage: cooling the steel rail cooled down in step b by accelerated cooling at a cooling rate that is 1.0~2.0° C./s higher than the cooling rate in the first accelerated cooling stage, till the temperature at the center of rail head surface is 450° C. or lower;
d. air cooling: stopping the accelerated cooling, and cooling down the steel rail by air cooling to room temperature.

Wherein, both the accelerated cooling in the first stage and the accelerated cooling in the second stage are carried out by applying a cooling medium to the rail head surface and both sides of the steel rail.

Any common cooling medium in the art is applicable to the present invention. Preferably, the cooling medium is at least one of compressed air, water-vapor mixture, and gas-oil mixture.

According to the present invention, preferably the temperature of the finished rolling steel rail is 850~1,000° C.

The heat treatment method for increasing the depth of hardening layer in steel rail provided in the present invention is applicable to steel rails with 0.75%~0.90% carbon content. A steel that contains the components of a pearlite steel rail is smelted in a rotary furnace or electric furnace, treated by LF refining, RH or VD vacuum treatment, and cast into a continuous casting billet with an appropriate cross section; the continuous casting billet is fed into a walking beam furnace, heated up to 1,200~1,300° C., and kept heat preservation for 2 h or longer; then, the billet is rolled into a steel rail with a required cross section. Here, the finished rolling temperature of the steel rail is 850~1,000° C.

In the heat treatment method for increasing the depth of hardening layer in a steel rail in the present invention, the accelerated cooling is carried out in two stages. In the first stage, the initial temperature of accelerated cooling is 660~730° C., the cooling rate is 1.5~3.5° C./s, and the final cooling temperature is 500~550° C., at which the second stage of accelerated cooling begins; in the second stage, the cooling rate is higher by 1.0~2.0° C./s than that in the first stage, and the final cooling temperature is 450° C. or lower; then, the accelerated cooling is stopped.

Wherein, the hot-rolled steel rail must be cooled by natural cooling till the temperature at the center of rail head surface is 660~730° C., before the accelerated cooling begin. The reason is: the steel rail is cooled continuously and slowly from an austenite phase region, and has phase transformation from austenite to pearlite when the temperature reaches to the phase transformation point and a required degree of super-cooling is obtained. If the accelerated cooling is started directly at a high temperature after the steel rail is rolled, the temperature of the surface layer of rail head will drop quickly owing to the direct action of the cooling medium on the surface layer of rail head; in contrast, though the temperature of the core part of rail head drops, the cooling rate there is lower than that in the surface layer of rail head, because the core part of rail head only suffers the heat transfer in the surface layer of rail head and to certain depth; especially, since the surface layer of rail head releases latent heat of phase transformation, the hardness of the core part of rail head can't decrease further; instead, it may increase. Consequently, the degree of super-cooling for phase transformation to pearlite is low, and expected properties (e.g., hardness) can't be obtained. The above problem can be avoided effectively if the accelerated cooling is started when the temperature at the center of rail head surface dropping to 660~730° C.; if the initial temperature of accelerated cooling is higher than 730° C., expected properties can't be obtained because the degree of super-cooling for phase transformation in the core part of rail head is too low; if the initial temperature of accelerated cooling is lower than 660° C., unwanted structures such as bainite and martensite may occur owing to a high degree of super-cooling because the temperature of the surface layer of rail head reaches to the phase transformation temperature quickly in the early stage of accelerated cooling, resulting in an unacceptable steel rail product. Therefore, the initial temperature of first accelerated cooling stage is set to 660~730° C.

The cooling rate in the first accelerated cooling stage is 1.5~3.5° C./s. If the cooling rate is lower than 1.5° C./s, it is unable to give full play to the refined crystalline strengthening effect that occurs in the heat treatment process; as a result, neither the properties of the surface layer of the steel rail nor the properties of the core part can be improved effectively. If the cooling rate is higher than 3.5° C./5, there is also a risk of occurrence of unwanted structures in the surface layer of rail head in the phase transformation process. Hence, the cooling rate in the first accelerated cooling stage should be 1.5~3.5° C./s.

The initial temperature in the second accelerated cooling stage is 500~550° C. If the final cooling temperature of the surface layer of rail head is lower than 500° C., the contribution of a further increased cooling rate to the improvement of the hardness of the core part of rail head will be very limited, since the phase transformation has completed essentially in the surface layer of rail head and within a specific range of depth in the steel rail; if the final cooling temperature of the surface layer of rail head is higher than 550° C., an increased cooling rate will bring a threat to the microscopic structure of the steel rail at the boundary between the surface layer of rail head and the core part of rail head in the positive segregation region, since the phase transformation in the surface layer and within a certain depth of the steel rail has not completed yet. Hence, the initial temperature in the second accelerated cooling stage is set to 500~550° C.

The cooling rate in the second accelerated cooling stage is increased by 1.0~2.0° C./s on the basis of the 1.5~3.5° C./s cooling rate in the first accelerated cooling stage, because: the cooling rate in the core part of rail head is lower than that in the surface layer of rail head that is directly subject to the cooling action of the cooling medium; in addition, the core part of rail head must be cooled at a quick cooling rate also, in order to obtain properties comparable to those of the surface layer, in view of the effect of latent heat of phase transformation. If the increased amount of cooling rate is less than 1.0° C./s, expected properties (e.g., high hardness) can't be obtained, though the degree of super-cooling for phase transformation in the core part of rail head is increased to some degree; if the increased amount of cooling rate exceeds 2.0° C./s, a risk of occurrence of unwanted structures will occur also. Therefore, the cooling rate in the second stage is increased by 1.0~2.0° C./s on the basis of the cooling rate in the first stage.

When the temperature at the center of rail head surface drops to 450° C. or lower, continuing the accelerated cooling is meaningless since the phase transformation has completed across the cross section of the rail head. At this point, the follow-up procedures can be started, and ultimately a finished steel rail product can be obtained.

In the present invention, air cooling and natural cooling are virtually the same process, i.e., cooling in air at room temperature, wherein, preferably the room temperature is 0-40° C.

In the present invention, all contents refer to mass content, unless otherwise specified.

Hereunder the present invention will be further detailed in some examples, but the present invention is not limited to these examples.

EXAMPLE 1

The chemical composition of rail steel is: C: 0.75%, Si: 0.68%, Mn: 0.85%, P: 0.014%, S: 0.007%, Cr: 0.03%, V: 0.07%, and Fe (the remaining content).

A steel that contains the components described above is smelted in a rotary furnace or electric furnace, treated by LF refining, RH or VD vacuum treatment, and cast into a continuous casting billet with an appropriate cross section; the continuous casting billet is fed into a walking beam furnace, heated up to 1,200~1,300° C., and kept heat preservation for 2 h or longer time; then, the billet is rolled into a steel rail in 60 kg/m unit weight. Here, the finished rolling temperature of the steel rail is 850~1,000° C.

The steel rail with residual heat is erected with a turnover device on a roller way for natural cooling. When the temperature at the center of rail head surface drops to 693° C., a cooling medium (compressed air) blast at 2.6° C./s is applied to the rail head surface and both sides of steel rail continuously, till the temperature at the center of rail head surface drops to 500° C.; then, the cooling rate is increased to 3.7° C./s, and the cooling is continued, till the temperature at the center of rail head surface drops to 448° C.; next, the accelerated cooling is stopped, and the steel rail is cooled by air cooling to room temperature.

Microscopic structure samples are taken from the round corner part of rail head of the heat-treated steel rail, and then Φ 10 mm tensile samples are taken from the round corner part of rail head and at a position at 25 mm distance from the surface layer of rail head respectively. Then, tensile strength (Rm) and specific elongation (A) are tested; Brinell hardness is measured on the rail head surface (after 0.5 mm decarburized layer is ground off) and a cross section at 25 mm distance from the surface layer of rail head respectively. Finally, weight loss resulted from wearing is measured at 5 mm below the rail head surface and 25 mm from the surface layer respectively. Thus, the mechanical properties of the steel rail in example 1 are obtained, as shown in Table 3.

Wherein, wearing tests are carried out on a MM200 wear testing machine to test the average weight loss resulted for wearing. The samples are taken from the rail heads of the steel rails obtained in the A1-A6 and D1-D6. In all of the wearing tests, the lower grinding parts are made of the same material. The testing parameters are as follows:

Sample size: round sample in 10 mm thickness and 36 mm diameter

Test load: 150 kg

Slippage: 10%

Material of opposite lower grinding part: wheel steel with 260-300HB hardness

Rotation speed: 200 rpm

Total wearing cycles: 100,000 cycles.

EXAMPLES 2~6

The chemical composition of steel and the parameters of heat treatment process in example 1 are modified, to obtain examples 2~6.

Table 1 lists the chemical compositions of the steel billets in examples 1~6, and Table 2 lists the control parameters of heat treatment process in examples 1~6 (including initial cooling temperature in the first stage, cooling rate in the first stage, initial cooling temperature in the second stage, cooling rate in the second stage, and final cooling temperature of accelerated cooling), and Table 3 lists the mechanical property test results of examples 1~6 (including tensile strength Rm, specific elongation A, hardness, and wearing weight loss of surface layer of rail head and core part of rail head at 25 mm from the surface layer).

COMPARATIVE EXAMPLES 1~6

Six groups of billets in different chemical components are treated with the treatment method in the prior art, wherein, the chemical compositions of the billets are shown in Table 1, and the control parameters of heat treatment process are shown in Table 2. The heat treatment method involves only one accelerated cooling procedure. Then, mechanical property test are carried out with the methods described in example 1. The results are shown in Table 3.

TABLE 1

Chemical Compositions of Steel Billets in the examples and Comparative Examples of the Present Invention

| | Chemical Composition/% | | | | | | |
|---|---|---|---|---|---|---|---|
| | C | Si | Mn | P | S | Cr | V |
| Example 1 and comparative example 1 | 0.75 | 0.68 | 0.85 | 0.014 | 0.007 | 0.03 | 0.07 |
| Example 2 and comparative example 2 | 0.78 | 0.78 | 1.05 | 0.012 | 0.008 | 0.24 | 0.06 |
| Example 3 and comparative example 3 | 0.80 | 0.69 | 1.18 | 0.014 | 0.010 | 0.33 | — |
| Example 4 and comparative example 4 | 0.85 | 0.54 | 0.93 | 0.011 | 0.006 | 0.58 | — |
| Example 5 and comparative example 5 | 0.88 | 0.96 | 0.69 | 0.009 | 0.012 | 0.13 | — |
| Example 6 and comparative example 6 | 0.90 | 0.85 | 1.35 | 0.018 | 0.008 | 0.26 | — |

TABLE 2

Control Parameters of Heat Treatment Process in the Embodiments and Comparative Example of the Present Invention

| | No. | Initial Cooling Temperature in the First Stage (° C.) | Cooling Rate in the First Stage (° C./s) | Initial Cooling Temperature in the Second Stage (° C.) | Cooling Rate in the Second Stage (° C./s) | Final Cooling Temperature of Accelerated Cooling (° C.) |
|---|---|---|---|---|---|---|
| Example 1 | A1 | 693 | 2.6 | 500 | 3.7 | 448 |
| Example 2 | A2 | 680 | 2.0 | 515 | 3.8 | 439 |
| Example 3 | A3 | 717 | 2.4 | 550 | 3.6 | 446 |
| Example 4 | A4 | 706 | 3.0 | 538 | 4.0 | 429 |
| Example 5 | A5 | 730 | 2.9 | 545 | 4.2 | 441 |
| Example 6 | A6 | 688 | 2.2 | 529 | 4.0 | 437 |
| Comparative example 1 | D1 | 850 | 2.6 | — | | 448 |
| Comparative example 2 | D2 | 798 | 2.0 | — | | 439 |
| Comparative example 3 | D3 | 826 | 2.4 | — | | 446 |
| Comparative example 4 | D4 | 811 | 3.0 | — | | 429 |

TABLE 2-continued

Control Parameters of Heat Treatment Process in the Embodiments and Comparative Example of the Present Invention

| | No. | Initial Cooling Temperature in the First Stage (° C.) | Cooling Rate in the First Stage (° C./s) | Initial Cooling Temperature in the Second Stage (° C.) | Cooling Rate in the Second Stage (° C./s) | Final Cooling Temperature of Accelerated Cooling (° C.) |
|---|---|---|---|---|---|---|
| Comparative example 5 | D5 | 804 | 2.9 | — | | 441 |
| Comparative example 6 | D6 | 758 | 2.2 | — | | 437 |

TABLE 3

Mechanical Properties of the Examples and Comparative Examples of the Present Invention

| | | Surface Layer of Rail Head | | | | Core Part of Rail Head At 25 mm from Surface Layer | | | |
|---|---|---|---|---|---|---|---|---|---|
| | | Tensile Property | | | Weight Loss Resulted from | Tensile Property | | | Weight Loss Resulted from |
| | No. | Rm (MPa) | A (%) | Hardness (HB) | Wearing (g) | Rm (MPa) | A (%) | Hardness (HB) | Wearing (g) |
| Example 1 | A1 | 1290 | 12.0 | 375 | 0.5326 | 1280 | 11.5 | 372 | 0.5433 |
| Example 2 | A2 | 1380 | 11.5 | 398 | 0.3954 | 1380 | 12.0 | 388 | 0.4001 |
| Example 3 | A3 | 1320 | 12.5 | 387 | 0.4155 | 1310 | 12.0 | 384 | 0.4298 |
| Example 4 | A4 | 1360 | 11.0 | 378 | 0.4821 | 1360 | 11.5 | 375 | 0.4959 |
| Example 5 | A5 | 1390 | 10.5 | 392 | 0.3788 | 1380 | 11.0 | 389 | 0.3851 |
| Example 6 | A6 | 1410 | 10.0 | 401 | 0.3157 | 1390 | 10.5 | 391 | 0.3196 |
| Comparative example 1 | D1 | 1270 | 12.0 | 372 | 0.5412 | 1180 | 11.5 | 357 | 0.7855 |
| Comparative example 2 | D2 | 1360 | 12.0 | 386 | 0.4115 | 1280 | 10.5 | 372 | 0.7621 |
| Comparative example 3 | D3 | 1310 | 11.5 | 378 | 0.4283 | 1200 | 11.0 | 363 | 0.7755 |
| Comparative example 4 | D4 | 1370 | 10.5 | 385 | 0.4911 | 1280 | 11.0 | 369 | 0.8124 |
| Comparative example 5 | D5 | 1370 | 11.5 | 390 | 0.4234 | 1290 | 11.5 | 371 | 0.7998 |
| Comparative example 6 | D6 | 1400 | 10.5 | 398 | 0.3289 | 1320 | 10.0 | 375 | 0.6254 |

Here, six groups of steel rails in different chemical compositions are selected for comparison. All of the six treatment methods used in the examples are the method disclosed in the present invention; the treatment method used in the comparative examples is the heat treatment method in the prior art. It is verified that all the microscopic structures of the steel rails in the examples and comparative examples are pearlite, without unwanted structures such as bainite and martensite, etc. The comparison results in Tables 1~3 indicate: under the condition of the same chemical composition and the same smelting and rolling process, the post-rolling heat treatment method of the steel rail has significant influence on the final properties of the steel rail, embodied in: for the surface layer of rail head, the influence of the heat treatment processes in the examples and comparative examples on the tensile property, hardness, and weight loss resulted from wearing is limited, i.e., in the early service stage of the steel rail, similar service performance is obtained through the two processes. In the service process, as the surface layer of rail head is worn down, significant differences in the properties of the core part of rail head exhibit. With the heat treatment method used in the examples, the properties of the core part of rail head at 25 mm from the surface layer are similar to those of the surface layer of rail head; in other words, the properties of the steel rail across the cross section from the surface layer of rail head to the core part of rail head 25 mm are essentially uniform, without severe degradation. In contrast, in the comparative examples treated through the heat treatment process in the prior art, the properties of the core part at 25 mm from the surface layer of rail head are apparently lower than those of the surface layer of rail head, and the weight loss resulted from wearing under the same conditions is severely increased. Hence, it is difficult for the steel rail in service to maintain high and persistent service performance in the wearing process.

What is claimed is:

1. A heat treatment method for increasing the depth of hardening layer in a steel rail, the method comprising the following steps:

a. natural cooling: cooling a finished rolling steel rail by natural cooling, till the temperature at the center of rail head surface drops to 660~730° C.;

b. first accelerated cooling stage: cooling the steel rail cooled down in step a by accelerated cooling at 1.5~3.5° C./s cooling rate, till the temperature at the center of rail head surface is 500~550° C.;

c. second accelerated cooling stage: cooling the steel rail cooled down in step b by accelerated cooling at a cooling rate that is 1.0~2.0° C./s higher than the cooling rate in the first accelerated cooling stage, till the temperature at the center of rail head surface is 450° C. or lower;

d. air cooling: stopping the accelerated cooling, and cooling down the steel rail by air cooling to room temperature, and wherein the carbon content in the steel rail is 0.75%~0.90%, the silicon content in the steel rail is 0.54%~0.96%, the manganese content in the steel rail is 0.69%~1.35%, the phosphorus content in the steel rail is 0.009%~0.018%, the sulphur content in the steel rail is 0.006%~0.012%, the chromium content in the steel rail is 0.03%~0.58%, the vanadium content in the steel rail is 0~0.07%, and the remaining content is ferrum.

2. The heat treatment method for increasing the depth of hardening layer in a steel rail according to claim 1, wherein the accelerated cooling in step b and step c is carried out by applying a cooling medium to the rail head surface and both sides of the steel rail.

3. The heat treatment method for increasing the depth of hardening layer in a steel rail according to claim 2, wherein the cooling medium is at least one of compressed air, a water-vapor mixture, and a gas-oil mixture.

4. The heat treatment method for increasing the depth of hardening layer in a steel rail according to claim 1, wherein the temperature of the finished rolling steel rail is 850~1,000° C.

5. The heat treatment method for increasing the depth of hardening layer in a steel rail according to claim 2, wherein the temperature of the finished rolling steel rail is 850~1,000° C.

6. The heat treatment method for increasing the depth of hardening layer in a steel rail according to claim 3, wherein the temperature of the finished rolling steel rail is 850~1,000° C.

* * * * *